US005125881A

United States Patent [19]

Jones

[11] Patent Number: 5,125,881

[45] Date of Patent: Jun. 30, 1992

[54] REAR DELTOID EXCERCISE MACHINE

[75] Inventor: Gary A. Jones, Falmouth, Ky.

[73] Assignee: Hammer Strength Corporation, Cincinnati, Ohio

[21] Appl. No.: 627,325

[22] Filed: Dec. 14, 1990

[51] Int. Cl.[5] ..... A63B 21/06

[52] U.S. Cl. ..... 482/97; 482/100; 482/93

[58] Field of Search ..... 272/123, 116, 137, 144, 272/118, 117, 133, 134

[56] References Cited

U.S. PATENT DOCUMENTS

| | | | |
|---|---|---|---|
| 3,640,527 | 2/1972 | Proctor | 272/118 |
| 3,858,873 | 1/1975 | Jones . | |
| 3,998,454 | 12/1976 | Jones | 272/117 |
| 4,720,099 | 1/1988 | Carlson | 272/134 |

OTHER PUBLICATIONS

Cybex strength systems, 272-118 Dec. 1989.

Instruction Manual, Leverage Machines by Nautilus, p. 13, 1989.

High Intensity Strength Training Equipment, p. 155, The Nautilus Book.

*Primary Examiner*—Robert Bahr

*Assistant Examiner*—Jerome Donnelly

*Attorney, Agent, or Firm*—Wood, Herron & Evans

[57] ABSTRACT

A rear deltoid exercise machine includes a frame, a bench supported by the frame along a vertical midplane and two independently pivotal levers connected to the frame on opposite sides of the midplane adjacent a head end of the bench. Each lever includes a hub adapted to hold at least one removable weight, a connector that extends rearwardly toward the bench and an actuating pad at the rear end of the connector. With the backs of the upper arms engaging inwardly directed surfaces of the actuating pads, an exerciser lying face down on the bench may pivotally raise the levers upwardly, through shoulder adductive motion, against the weight supported on the hubs to exercise the rear deltoid muscle groups.

15 Claims, 3 Drawing Sheets

REAR DELTOID EXCERCISE MACHINE

FIELD OF THE INVENTION

This invention relates to a rear deltoid exercise machine.

BACKGROUND OF THE INVENTION

Among both athletes and non-athletes, the popularity of weight training exercise has substantially increased in the past ten years. In addition to the use of traditional "free weights," i.e., plate-loaded barbells or dumbbells, weight training exercises are also performed with a number of specialized exercise machines that work a particular muscle group through a prescribed motion or exercise maneuver. Generally, for most exercise maneuvers that may be performed either on a machine or with free weights, exercise machines tend to be safer. Moreover, from a practical standpoint, certain exercise maneuvers are simply more efficient and beneficial when performed on an exercise machine, particularly when the major purpose for performing weight training is to rehabilitate an injured limb.

In addition to rehabilitation, another purpose of weight training is the prevention of injuries. By building up the muscles associated with a particular movement and the joints involved with that movement, the likelihood of injury can be reduced.

One muscle group that is exercised through a movement referred to as shoulder or scapula adduction includes the posterior aspect of the deltoid and the rhomboid muscles. This muscle group is hereinafter referred to as the rear deltoid muscle group. While an exerciser may exercise the rear deltoid muscle group by lying face down on a bench, grasping dumb-bells in each hand and pulling them upwardly on opposite sides of the bench in a shoulder adductive movement, this motion does not adequately isolate the rear deltoid muscle group because the motion is actually more of a pulling or raising movement than an adductive motion.

Moreover, when using dumbbells to perform this exercise, the pulling movement is rather jerky and, in some cases, may cause injury to the exerciser, particularly if the exerciser is trying to lift too much weight. Optimally, to maximize muscular benefit to the rear deltoid muscle group, a steady shoulder adductive movement through a large range of motion is desirable. The above-described dumbbell exercise does not provide steady shoulder adductive movement nor shoulder adductive movement through a sufficiently extensive range of motion.

One known rear deltoid exercise machine addresses some of the disadvantages associated with the use of dumbbells to exercise the rear deltoid muscle group. This machine locates the exerciser in a seated, upright, back supported position, with cushions adapted to be placed against the chest of the exerciser to wedge the front and back of the torso during the exercise. This rear deltoid exercise machine includes a pair of eccentric rotatable cams and a pair of chains, with one end of each chain connected to a cam to ride around the respective cam and an opposite end connected to a selectable weight resistance. Pads mounted on vertical arms connected to the cams are outwardly pivotal to rotate the cams in a horizontal plane to raise the weight resistance.

With the arms extended forwardly and the backs of the arms engaged against the inside surfaces of the pads, the shoulders are adducted in a continuous motion. The cushions are necessary to stabilize the position of the exerciser during shoulder adduction. With this machine, the exerciser is able to work the rear deltoid muscle group in a smooth manner through a relatively large range of adductive motion.

Nevertheless, this exercise machine suffers from a number of disadvantages. First, from a practical standpoint, the rotatable cams and chains require maintenance, as outlined in applicant's copending, commonly assigned patent applications Ser. Nos. 514,869 and 514,839. Otherwise, undesired friction builds up and adds to the weight resistance that must be moved by the exerciser during the exercise.

Second, the machine itself is relatively expensive. For some exercise facilities, the benefits of this machine may not justify the cost.

Third, this machine does not readily permit an exerciser to adequately work the rear deltoid muscle group for one side of the body at a time, a feature which is desirable when rehabilitating an injury.

Fourth, this rear deltoid exercise machine does not seem to quite "fit" the actual musculoskeletal make-up of a human being when performing a shoulder adductive movement. It is uncomfortable for an exerciser to sandwich himself or herself between front and back cushions in order to have sufficient leverage to perform the exercise. Moreover, the rotational movement of the arms through a horizontal plane feels awkward or uncomfortable to many athletes, due to some impingement upon the shoulder joint during motion in this prescribed plane.

It is an object of this invention to provide an improved rear deltoid exercise machine.

It is another object of this invention to provide a rear deltoid exercise machine which, compared to a prior deltoid exercise machine, is relatively inexpensive and more naturally accommodates the musculoskeletal make-up of a human being.

It is still another object of the invention to provide a rear deltoid exercise machine that is equally suitable for simultaneous exercise of both rear deltoid muscle groups, or alternate exercise of one rear deltoid muscle group at a time.

SUMMARY OF THE INVENTION

To these ends, a rear deltoid exercise machine includes a bench and pivotal levers connected to a frame on opposite sides of the bench. The levers are independently pivotal, in an upward direction, through a shoulder adductive motion by an exerciser lying face down on the bench.

Each lever includes a hub for holding at least one removable weight and an actuating pad that is acted upon by the exerciser to pivot the lever. An exerciser lying face down on the bench places his or her arms against the inwardly directed surfaces of the actuating pads and then adducts the shoulders to pivotally raise the levers, either simultaneously or alternatively, against the weight held on the hubs. This pivotal raising exercises the rear deltoid muscle group.

Because this rear deltoid exercise machine enables an exerciser to perform shoulder adduction against a weight resistance while lying face down on the bench, the exerciser is able to exert maximum leverage against the desired weight during the exercise, a feature which helps promote an optimal strength increase of the rear deltoid muscle group. Moreover, because rotatable levers are employed, shoulder adduction is performed in a steady manner through a relatively large range of motion. These advantages maximize the muscular benefit to the rear deltoid muscle group.

According to a preferred embodiment of the invention, this rear deltoid exercise machine includes a frame, a bench connected to the frame along a vertical midplane and two levers pivotally connected to the bench on opposite sides of the midplane adjacent a head end of the bench. Each lever includes a hub adapted to hold at least one removable weight, a counterweight located opposite the lever pivot point from the hub, a connector that extends rearwardly toward the bench and an actuating pad secured at a free end of the connector. Each actuating pad is adapted to be acted upon by the back of an arm of an exerciser lying face down on the bench during shoulder adductive motion to exercise the rear deltoid muscle group. The counterweight substantially counterbalances the weight of the hub, connector and actuating pad. A head cushion or head pad mounted adjacent the head end of the bench supports the head of an exerciser lying on the bench. The bench includes two sections, a forward section that tilts forwardly from horizontal in the direction of the levers, and a rear section that tilts rearwardly from horizontal in the direction away from the levers.

While lying face down, the exerciser places his or her arms against the inwardly directed surfaces of the actuating pads. Then, by adducting the shoulders with the backs of the arms remaining against the pads, the levers are pivotally raised upwardly against the weight supported by the hubs. This shoulder adductive movement exercises the rear deltoid muscle groups on both sides of the body. With this invention, rear deltoid exercise may be performed simultaneously with both arms, or alternately with both arms, or one arm at a time.

Additionally, the rear deltoid muscle group on one side of the body may be worked with relatively low weight, a feature that is particularly advantageous during rehabilitation because it facilitates comparison of relative strength between the rear deltoid muscle group on the right and left sides of the body. Moreover, each counterweight substantially counterbalances the weight of the hub, the connector and actuating pad of the respective lever. Therefore, the total weight of the lever without any weight supported on the hub is very low. This feature is also advantageous for rehabilitation because it enables the exerciser to exercise against extremely low weight resistances and to accurately measure the progress or recovery of a rear deltoid muscle group through small incremental increases in weight resistance.

The structural orientation of the individual components of this rear deltoid exercise machine are particularly designed to more naturally accommodate the musculoskeletal make-up of the human body during exercise of the rear deltoid muscle group through a shoulder adductive motion. The levers are pivotally connected to the frame such that their pivot axes are non-parallel with a vertical midplane through the bench. The axes of pivotal movement converge longitudinally toward the bench and also tilt downwardly toward the bench. In another manner of describing this arrangement, the planes of movement of the levers, which are perpendicular to a respective pivot axis, are angled rearwardly toward the bench. The structural orientation of the machine components provides natural positions for coupling applied shoulder adductive motion to rearwardly angled planes of motion.

The particular structural orientation of the components of this rear deltoid exercise machine was arrived at by applicant after many years of observation and experience in exercise and weight training facilities across the United States, coupled with his knowledge, experience and observation of the musculoskeletal movements of athletes during performance. Applicant observed that, while most athletic movements involve compound angles or movement of multiple joints through three dimensional space, almost all exercise machines are designed specifically for movement of the limbs through restricted planes or angles that are generally oriented 90° with respect to the torso, or with respect to the joints involved.

For many individuals, use of these machines produced unnecessary joint stress, due to the imposed restrictions in degrees of freedom of movement. In other words, many individuals felt "confined" in these machines. While applicant believed that exercise machines of this type could prove somewhat beneficial to athletes in strengthening the limbs, he also concluded that exercise machines more suited to the actual musculoskeletal make-up of the human body would provide optimum muscular benefit if more natural bodily movements were simulated. With this premise, applicant set out to improve upon prior exercise machines. Based upon feedback from a number of individuals who lift weights to maintain peak physical condition to compete in professional sports, applicant has succeeded in achieving this goal for a variety of weight training exercise machines. This rear deltoid exercise machine represents one of these successes.

These and other features of the invention will be more readily understood in view of the following detailed description and drawings.

DETAILED DESCRIPTION OF THE DRAWINGS

Figure 1:
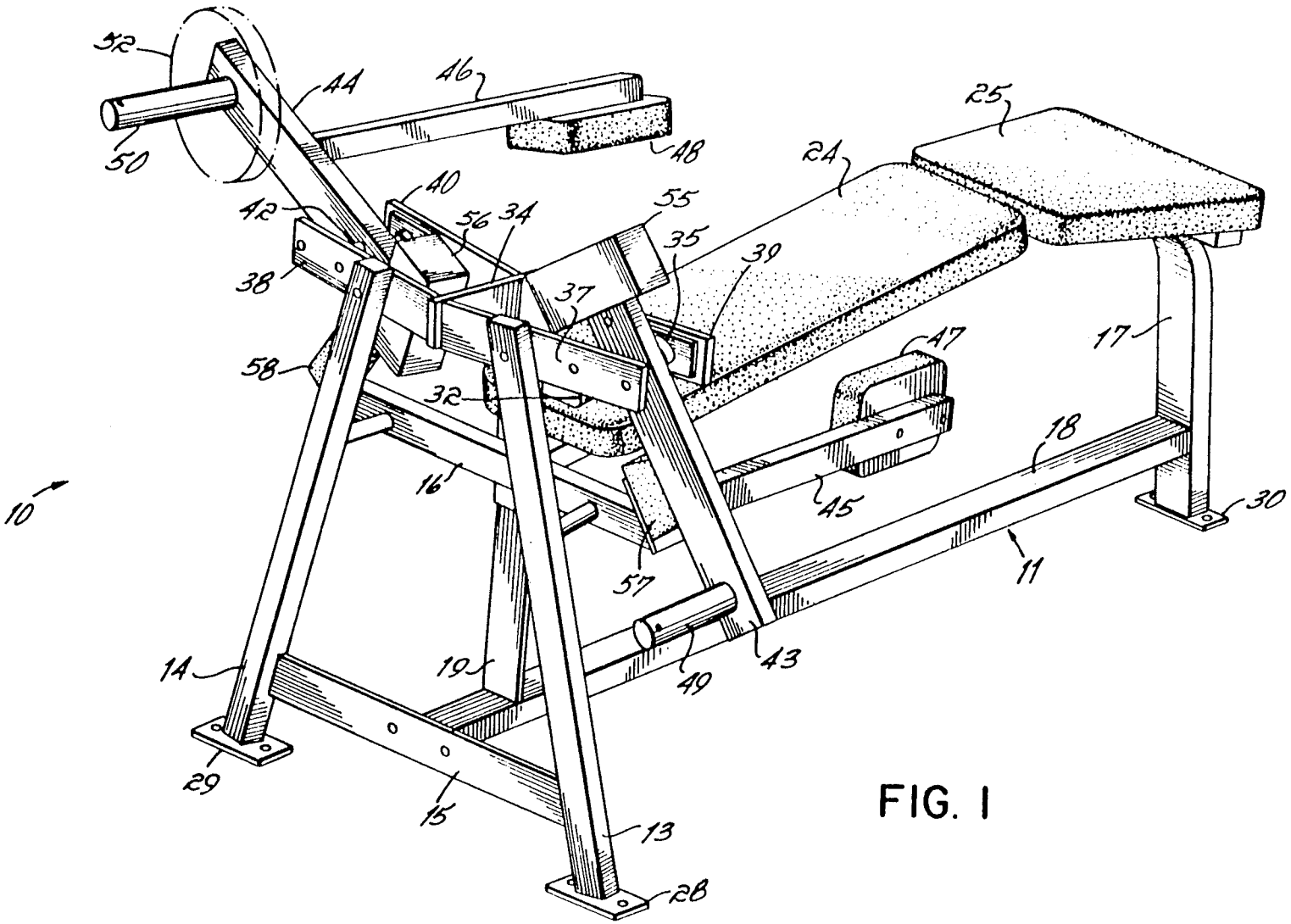
FIG. 1 is a perspective view of a rear deltoid exercise machine in accordance with a preferred embodiment of the invention.
Figure 2:
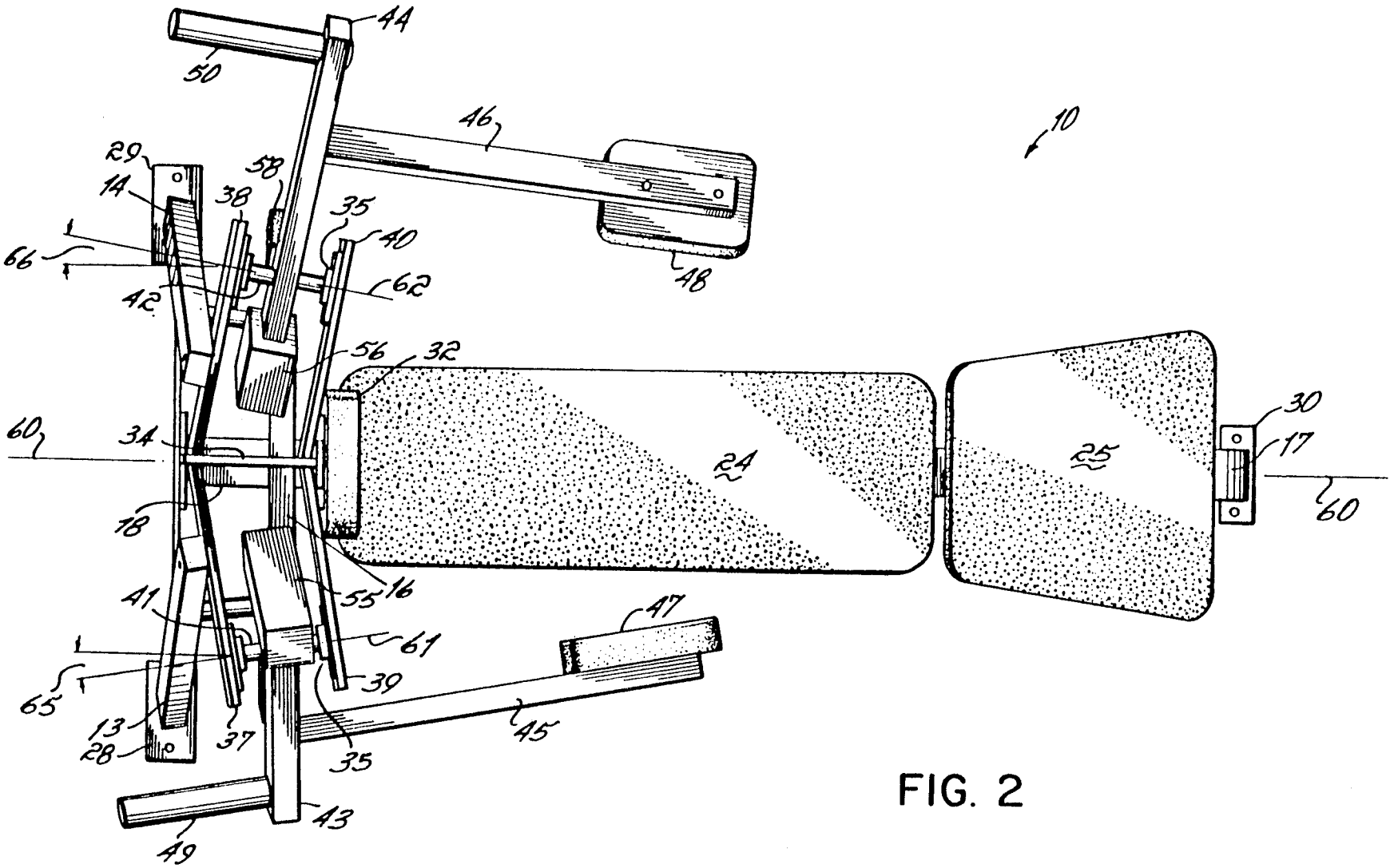
FIG. 2 is a top plan view of the rear deltoid exercise machine shown in FIG. 1.
Figure 3:
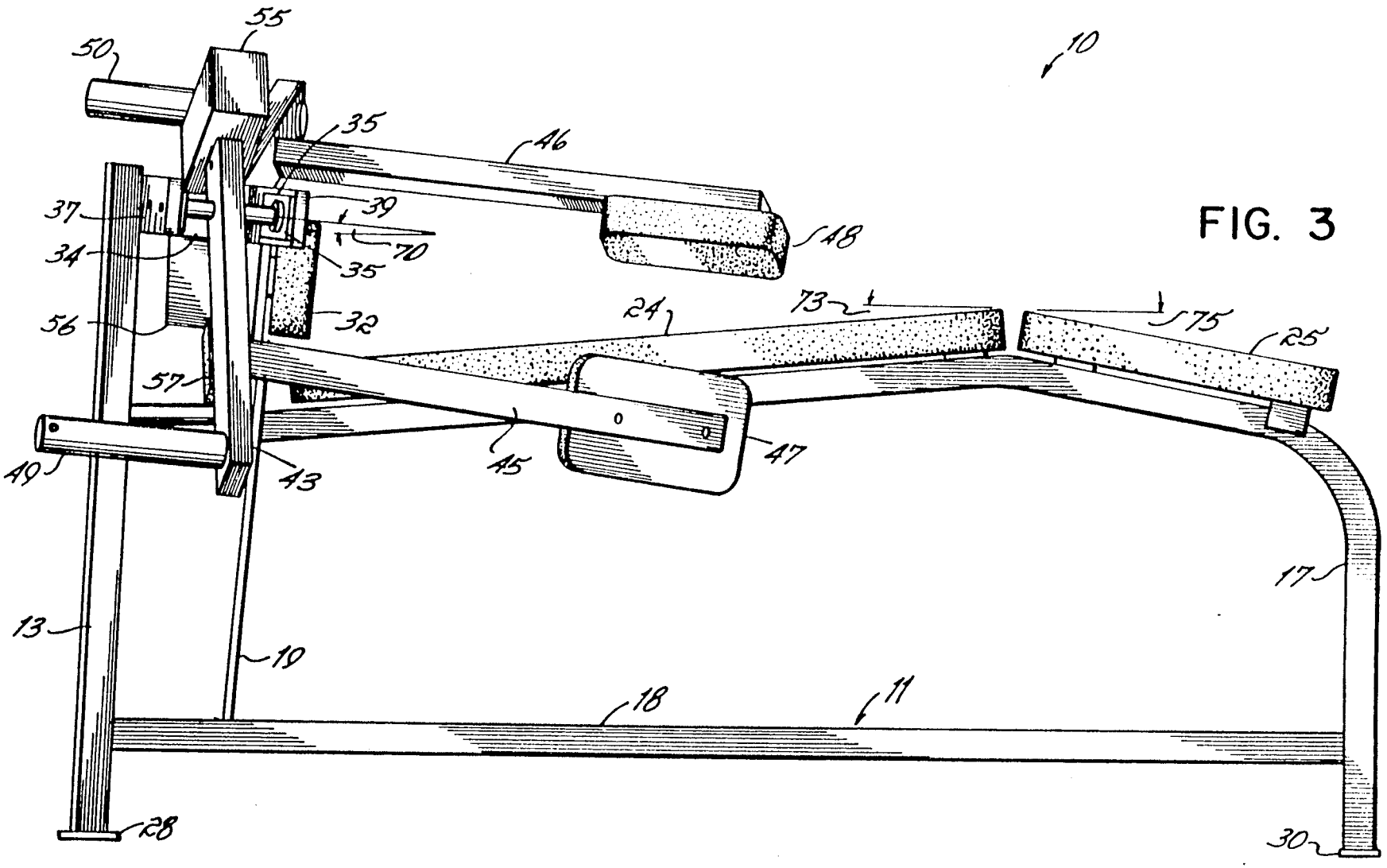
FIG. 3 is a side view of the rear deltoid exercise machine shown in FIG. 1.

FIGS. 1-3 show a rear deltoid exercise machine 10 in accordance with a preferred embodiment of the invention. The machine 10 includes a frame 11 of metal parts either connected together by nut and bolt connections or welds. The frame 11 includes side legs 13 and 14 which extend upwardly at an angle and are connected together by a lower brace 15 and an intermediate brace 16. A longitudinally extending leg 17 extends longitudinally in a rearward direction and then bends downwardly to ground support one end of the frame 11. A longitudinal brace 18 connects between the rearward end of longitudinal leg 17 and lower brace 15. A center support 19 extends upwardly from longitudinal brace 18 to support a forward end of leg 17. The longitudinal leg 17 supports a bench which includes a forwardly tilting pad 24 and a rearwardly tilting pad 25. Legs 13, 14 and 17 are supported at their bottom ends by metal plates 28, 29 and 30, respectively. Preferably, bolt holes are provided in plates 28, 29 and 30 to facilitate secured placement of the machine 10 in a weight room or during transit. Center support 19 also supports a head pad or head cushion 32 that faces rearwardly.

Center support 19 and upper ends of legs 13 and 14 support a longitudinally oriented center plate 34 and bracket sections 37, 38, 39 and 40. Bracket sections 37 and 39 are spaced and parallel to each other, and they are angled rearwardly toward the bench. Bracket sections 37 and 39 also tilt downwardly from horizontal in the direction of the bench. Similarly, bracket sections 38 and 40 extend in spaced, parallel fashion from center plate 34 toward leg 14. Bracket sections 38 and 40 are also angled rearwardly toward the bench 24, and they both tilt downwardly from horizontal toward the bench 24.

Each pair, 37 and 39, and 38 and 40 of bracket sections includes two oppositely mounted bearings 35 which support an axle rigidly connected to a lever. A pillow block bearing sold by Browning, Part No. VF 2S 116 has proved suitable. These bearings require maintenance only once a year, which consists of one shot of lubricating oil. Bracket sections 37 and 39 support axle 41 which is rigidly connected to lever 43. Bracket sections 38 and 40 support axle 42 which is rigidly connected to lever 44. Each lever includes a forwardly extending hub for supporting one or more removable weighted plates, a connector that extends rearwardly from the lever in a perpendicular direction, and an actuating pad secured to a rearward end of the connector. As shown in FIG. 1, lever 43 includes connector 45, actuating pad 47, and hub 49 for supporting a weight 52. Similarly, lever 44 includes connector arm 46, actuating pad 48, and weight supporting hub 50 for supporting a weight 52 (shown in phantom). Each of the levers also includes a counterweight. Counter weight 55 is connected to an inner end of lever 43, and counterweight 56 is connected to the inner end of lever 44. Preferably, each side of the machine also includes rubber stops that limit downward movement of levers 43 and 44 with respect to the frame 11. Rubber stop 57 is connected to one end of immediate brace 16 and limits downward movement of lever 43. Rubber stop 58 is connected to an opposite end of brace 16 and limits downward movement of lever 44.

As shown in FIG. 1, stop 57 holds lever 43 in an initial at rest position, with the actuating pad 47 directed generally horizontally toward the bench. FIG. 1 also shows lever 44 in a pivotally raised position, with actuating pad 48 directed generally downwardly.

As shown most clearly in FIG. 2, the frame 11 is symmetric with respect to a vertical midplane 60 along the length of the machine 10. FIG. 2 also shows that each of the levers pivots about an axis that is non-parallel with midplane 60. Lever 43 pivots about axis 61, and lever 44 pivots about axis 62. Neither axis 61 nor axis 62 is parallel with midplane 60. Rather, the axes converge rearwardly toward bench sections 24 and 25. Numerals 65 and 66 designate the rearward angles of convergence of axis 61 and 62, respectively, which are preferably about 10°.

As shown more clearly in FIG. 3, each axis of pivotable movement also tilts downwardly from horizontal. Numeral 70 designates a downward angle of tilt for axis 62, an angle which is preferably about 5°. Although not shown, axis 61 tilts downwardly at the same angle. FIG. 3 also shows forward bench section 24 tilted forwardly at an angle designated by numeral 73. Preferably, this angle is about 5°. Rearward section 25 tilts rearwardly at an angle designated by numeral 75, preferably an angle of about 10°. This downward tilt also prevents held weights from falling off the hubs. As mentioned previously, the orientation and angles of the bench 24 and 25, the levers 43 and 44 and the axes of pivotal movement all combine to accommodate the natural musculoskeletal make-up of the human body.

After placing a desired amount of weight on the hubs 49 and 50, an exerciser (not shown) lies face down on the benches 24 and 25 with the top of the head supported against pad 32. The backs of the arms are placed in contact with the inwardly directed surfaces of actuating pads 47 and 48. The exerciser then pivots the levers 43 and/or 44 upwardly against the held weights in a rear deltoid exercise motion. Because the exercise is performed while lying down, the exerciser is able to exert maximum leverage against the selected weight resistance. Moreover, because each of the levers is independently maneuverable, the exerciser may pivot the levers simultaneously, alternately, or simply work one arm at a time, a feature that is particularly advantageous for many rehabilitation programs.

While I have described a preferred embodiment of this invention, it is to be understood that the invention is not limited thereby and that in light of the present disclosure of the invention, various other alternative embodiments will be apparent to a person skilled in the art. For instance, the structural orientation of some parts of the frame 11 is not critical, so long as the location of the bench with respect to the position of the pivot points and the levers and lever angles is maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A rear deltoid exercise machine comprising:

a frame;

a bench supported by the frame;

a lever pivotally connected to the frame adjacent a head end of the bench, one end of the lever adapted to hold at least one removal weight; and actuating means extending from the lever generally along the longitudinal direction of the bench and including an actuating surface adapted to be acted upon by the back of the upper arm of an exerciser lying face down upon the bench to pivotally raise the lever through shoulder adductive motion to exercise a rear deltoid muscle group, the actuating surface oriented generally vertically and facing the bench when the lever is in an initial at rest position and oriented generally horizontally and facing downwardly when the lever has been pivotally raised.

2. The rear deltoid exercise machine of claim 1 wherein the bench is aligned along a vertical midplane which extends from the head end to a foot end of the frame and the lever pivots about an axis that is non-parallel with the vertical midplane.

3. The rear deltoid exercise machine of claim 2 wherein the non-parallel lever axis converges longitudinally toward the vertical midplane in the direction of the foot end of the bench.

4. The rear deltoid exercise machine of claim 2 wherein the non-parallel lever axis tilts downwardly from horizontal in the direction of the foot end of the bench.

5. The rear deltoid exercise machine of claim 1 wherein the bench includes two sections, a first of the two sections declining forwardly from horizontal toward the head end of the bench and the other of the sections declining rearwardly from horizontal.

6. The rear deltoid exercise machine of claim 1 and further comprising:

a head support connected to the frame adjacent the head end of the bench and adapted to support the head of the exerciser during shoulder adductive motion.

7. The rear deltoid exercise machine of claim 6 wherein the bench extends along a vertical midplane, the lever act actuating means are located on one side of the midplane, and further comprising:

another lever, actuating means and actuating surface located on an opposite side of the vertical midplane and symmetric with the first lever, first actuating means and first actuating surface with respect to the vertical midplane.

8. A rear deltoid exercise machine comprising:

a frame;

a bench supported by the plane along a vertical midplane;

two levers pivotally connected to the frame on opposite sides of the midplane adjacent a head end of the bench, each lever having one end adapted to hold at least one removable weight; and two actuating means, each actuating means connected to a lever and including an actuating surface adapted to be acted upon by the back of the upper arm of an exerciser lying face down upon the bench to pivotally raise the respective lever through shoulder adductive motion to exercise a rear deltoid muscle group, each actuating surface oriented generally vertically and facing the vertical midplane when the respective lever is in an initial at rest position and oriented generally horizontally and facing downwardly when the lever is pivotally raised through shoulder adductive motion.

9. The rear deltoid exercise machine of claim 8 wherein the levers pivot about axes located on opposite sides of the midplane, each lever pivot axis being non-parallel with the midplane.

10. The rear deltoid exercise machine of claim 9 wherein each lever pivot axis converges longitudinally toward a foot end of the bench, opposite the head end.

11. The rear deltoid exercise machine of claim 10 wherein the angle of longitudinal convergence of each lever pivot axis is about 10°.

12. The rear deltoid exercise machine of claim 9 wherein each non-parallel lever pivot axis tilts downwardly from horizontal in the direction of a foot end of the bench, opposite the head end.

13. The rear deltoid exercise machine of claim 12 wherein each lever pivot axis tilts downwardly at an angle of about 5°.

14. The rear deltoid exercise machine of claim 8 and further comprising:

a head support connected to the frame adjacent the head end of the bench and adapted to engage against the top of the head of an exerciser during pivotal raising of the levers.

15. A rear deltoid exercise machine comprising:

a frame;

a bench supported by the frame along a vertical midplane;

a pair of rear deltoid exercise means connected to the frame on opposite sides of the midplane adjacent a head end of the bench, each rear deltoid exercise means having an actuating surface adapted to be contacted and pivoted upwardly by a rear portion of an arm of an exerciser lying face down on the bench during performance of shoulder adductive motion to exercise a rear deltoid muscle group, each rear deltoid exercise means being independently pivotal with respect to the frame, each actuating surface of a respective rear deltoid exercise means oriented generally vertically and facing the bench when in an initial at rest position and oriented generally horizontally and facing downwardly when pivoted upwardly through shoulder adductive motion.

* * * * *